US006318917B1

(12) United States Patent
Taylor

(10) Patent No.: US 6,318,917 B1
(45) Date of Patent: Nov. 20, 2001

(54) GASOLINE DISPENSING SYSTEM AND METHOD USING A SINGLE PRINTER

(75) Inventor: Ken W. Taylor, Oakridge, NC (US)

(73) Assignee: Dresser, Inc., Addison, TX (US)

( * ) Notice: Subject to any disclaimer, the term of this patent is extended or adjusted under 35 U.S.C. 154(b) by 0 days.

(21) Appl. No.: 09/197,277

(22) Filed: Nov. 20, 1998

Related U.S. Application Data

(60) Provisional application No. 60/066,117, filed on Nov. 21, 1997.

(51) Int. Cl.[7] ..... B41J 11/27; B41J 11/50; B41J 11/52

(52) U.S. Cl. ..... 400/613; 400/584; 400/621

(58) Field of Search ..... 400/613, 584, 400/583.4, 611, 612, 621, 625, 602, 603, 603.1, 642; 271/279–304, 184

(56) References Cited

U.S. PATENT DOCUMENTS

| | | | | |
|---|---|---|---|---|
| 3,472,506 | * | 10/1969 | Rabinow et al. | 271/304 |
| 3,668,375 | | 6/1972 | Smilgys et al. . | |
| 3,685,690 | * | 8/1972 | Karecki et al. | 221/218 |
| 3,786,421 | | 1/1974 | Wostl et al. . | |
| 3,931,497 | | 1/1976 | Gentile et al. . | |
| 4,917,514 | * | 4/1990 | Richardson et al. | 400/120 |
| 5,083,846 | * | 1/1992 | Day, Jr. et al. | 312/321.5 |
| 5,088,722 | * | 2/1992 | Olexy | 271/304 |
| 5,295,753 | * | 3/1994 | Godo et al. | 400/612 |
| 5,340,969 | | 8/1994 | Cox . | |
| 5,493,315 | | 2/1996 | Atchley . | |
| 5,915,692 | * | 6/1999 | Lu et al. | 271/279 |

* cited by examiner

*Primary Examiner*—John S. Hilten
*Assistant Examiner*—Charles H. Nolan, Jr.
(74) *Attorney, Agent, or Firm*—Jenkens & Gilchrist, P.C.

(57) ABSTRACT

A gasoline dispensing system and method according to which gasoline is dispensed from opposite ends of a dispenser system. A printer is mounted in the dispenser system for printing a receipt for a transaction occurring at one end of the dispensing system while access is provided to the printed receipt by the customer from the one end of the dispenser system. Access to the receipt by a customer from the other end of the dispenser system is prevented.

15 Claims, 10 Drawing Sheets

10a
10
14a
16
14
10c
10d
14b
10b
12a
13
12

13

100
100a
118a
118b
Gallons
Price/Gallon
Total
118
100c
100d
122
126
120
100b
112a
114
112
13

GASOLINE DISPENSING SYSTEM AND METHOD USING A SINGLE PRINTER

CROSS-REFERENCE TO RELATED APPLICATION

This application is based on provisional application Ser. No. 60/066,117 filed on Nov. 21, 1997.

BACKGROUND OF THE INVENTION

The present invention relates to a gasoline dispensing system and method and, more particularly, to such a system and method using a single printer for printing receipts for the purchase of gasoline.

In many gasoline services stations, the customer can purchase gasoline from a gasoline dispenser directly by credit card or the like. In connection with these transactions, a receipt for the customer is printed at the dispenser and is provided to the customer when the transaction is complete. However, in service station installations in which dispensing nozzles are provided on both ends of the dispenser housing in order to service two customers at once, separate printing units are usually provided which take up considerable space and adds to the complexity of the dispensing system. Also, the individual printing units and their associated cutters are expensive which adds to the cost and complexity of the system.

SUMMARY OF THE INVENTION

The present invention, accordingly, provides a gasoline dispensing system and method according to which a single printer can print receipts for customers dispensing gasoline from both ends of a dispenser. To this end, a printer is mounted in the dispenser unit for printing a receipt for a transaction occurring at one end of the dispensing unit while access is provided to the printed receipt by the customer from the one end of the dispenser unit. Access to the receipt by a customer from the other end of the dispenser unit is prevented.

A major advantage is thus achieved with the assembly and method of the present invention since the costs, complexity and space requirements of two printing assemblies are eliminated. Also, the printing assembly of the present application can use the bezel of a standard printing assembly with little modification. Further, the printing assembly is relatively simple in construction and durable.

DESCRIPTION OF THE PREFERRED EMBODIMENTS

Figure 1:
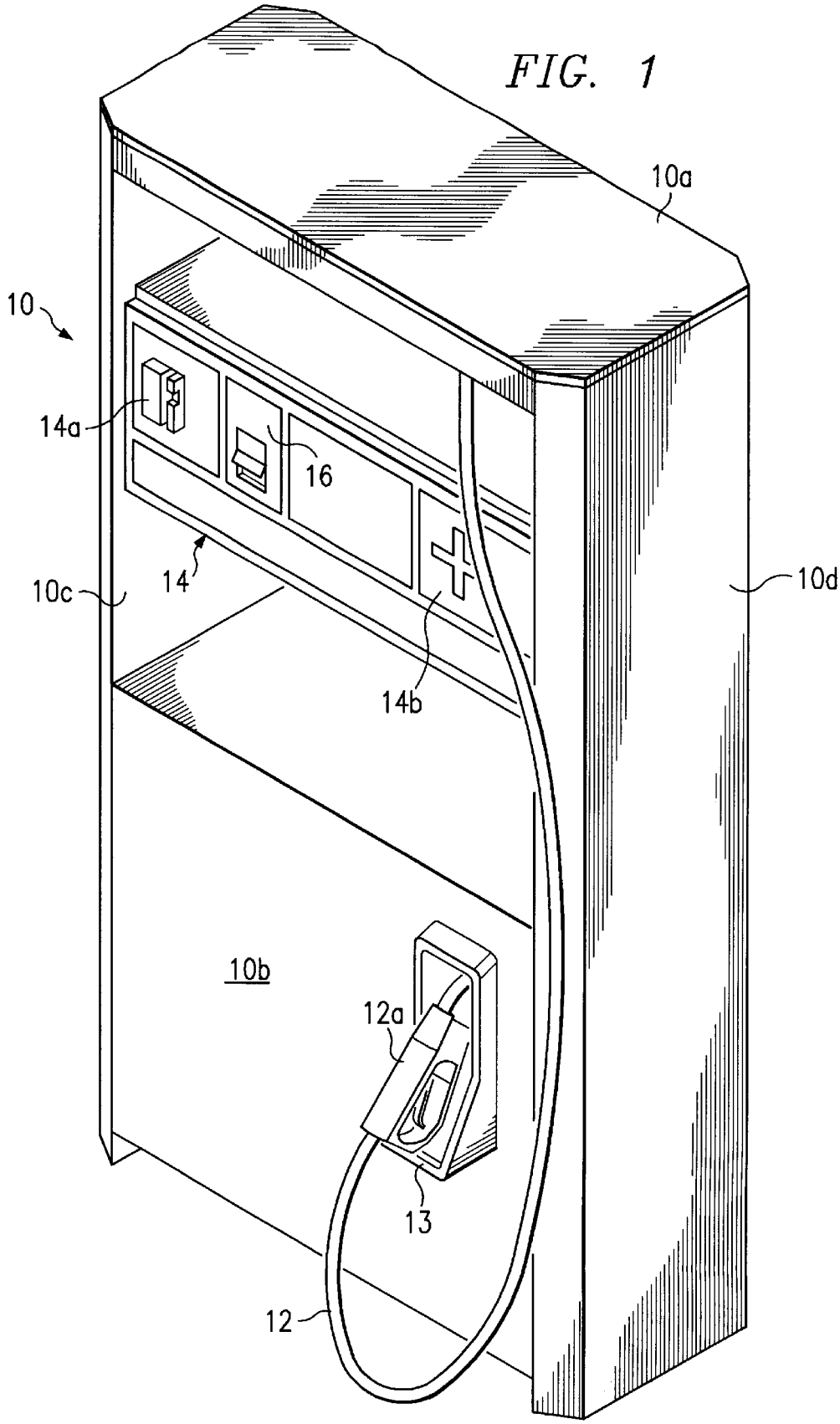
FIG. 1 is an isometric view of gasoline dispensing unit according to an embodiment of the present invention.

With reference to FIG. 1, the reference numeral 10 refers, in general, to a dispenser unit having an upper housing 10*a* and a lower housing 10*b* connected by two spaced support members 10*c* and 10*d*. The lower housing 10*b* contains hydraulics (not shown) including conduits that are connected to underground storage tanks for gasoline to be dispensed. A conduit (not shown) extends from the lower housing 10*b* to the upper housing 10*a* for passing gasoline to one end of a hose 12, the other end of which is connected to a nozzle 12*a* for dispensing gasoline from the storage tank to a vehicle. A boot 13 is provided on the front panel of the lower housing 10*b* for receiving the nozzle 12*a* during nonuse. An electronics housing 14 is provided in the upper housing 10*a* and contains various electronic components, including a credit card reader 14*a* and a display 14*b* which displays certain information relating the purchase of gasoline, as discussed above. The respective fronts of the reader 14*a* and the display 14*b* extend through the front panel, or bezel, of the housing 14.

Although not shown in the drawing, it is understood that a similar arrangement, including a hose and a nozzle, identical to the hose 12 and the nozzle 12*a*, are provided on the opposite, or rear, end of the dispenser unit 10, and that the electronics housing 14 also extends to this opposite end. In this manner, an additional customer can be serviced on both ends of the dispenser unit 10. Since all of this is conventional, it will not be described in further detail.

Figure 2:
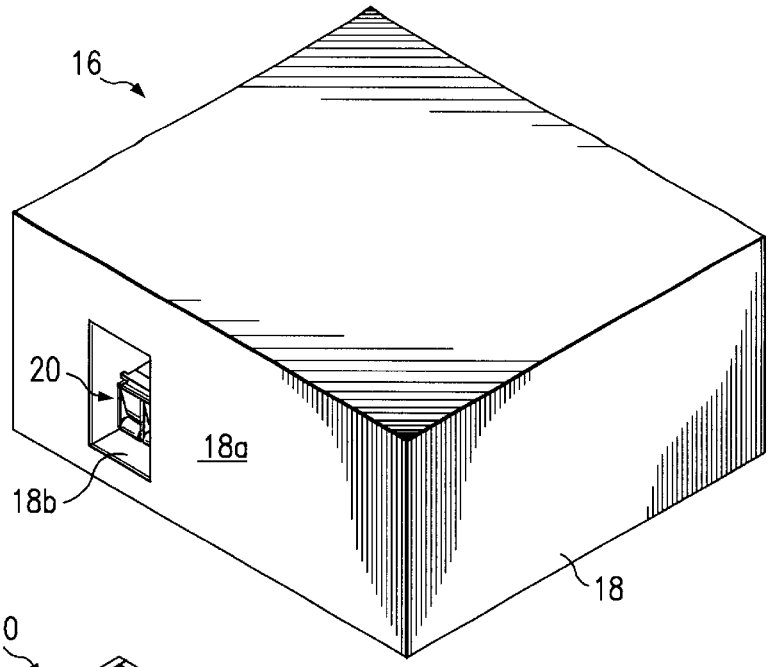
FIG. 2 is an isometric view of the printer module of FIG. 1.
Figure 3:
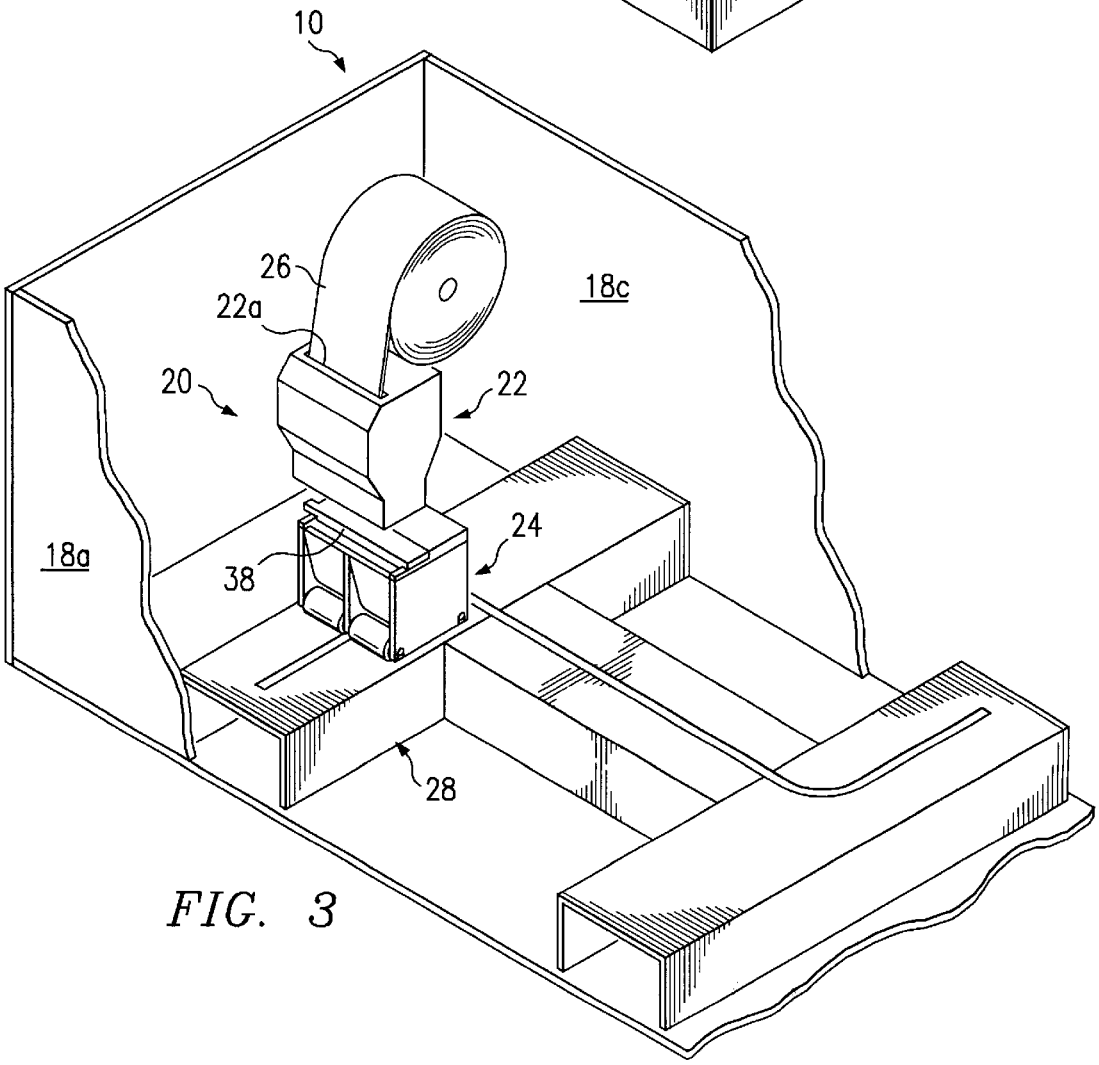
FIG. 3 is an enlarged view of the printer module of FIG. 2 with the portions of the module housing removed.

A printing module 16 is mounted in the electronic housing 14 and is shown in detail in FIGS. 2 and 3. The printing module 16 includes a cabinet 18 which extends from the front to the rear of the dispenser unit 10 and is shown only partially shown in FIG. 3 for the convenience of presentation. The cabinet 18 includes a front panel 18a flush with the front of the electronics housing 14, as viewed in FIG. 1, and has a window 18b formed therein. A door 19, shown partially lowered in FIG. 1, is provided for covering the window during nonuse of the printing module. The cabinet 18 also includes a rear panel 18*c* (FIG. 3) which extends flush with the rear panel (not shown) of the electronics housing 14 and it is understood that a window, identical to the window 18*b* extends through the rear panel 18*c* for servicing customers on both ends of the dispensing unit 10.

A printing assembly, shown in general by the reference numeral 20, is provided in the cabinet 18 and is shown in detail in FIG. 3. More particularly, the printing assembly 20 includes a printing head 22 mounted above a carrier 24 and adapted to receive tape 26 from a roll thereof positioned above the printing head. The printing head 22 has a slot 22*a* formed therein for receiving the tape 26 and is adapted to print information on the tape relating to each transaction involving dispensing gasoline from the dispenser unit 10, as described above. Since the printing head 22 is conventional it will not be described in further detail.

It is understood that the roll of tape 26 and the printing head 22 are mounted to the interior of the cabinet 18 by brackets, plates, or the like, which are not shown for the convenience of presentation, and that a motor or the like (not shown) is provided to advance the tape from the roll in a manner to allow the tape to pay out from the roll and into the slot 22*a* in the printing head. A track assembly 28 is provided in the cabinet 18 for guiding and supporting the carrier 24 for translational movement in the cabinet in a manner to be described.

Figure 4:
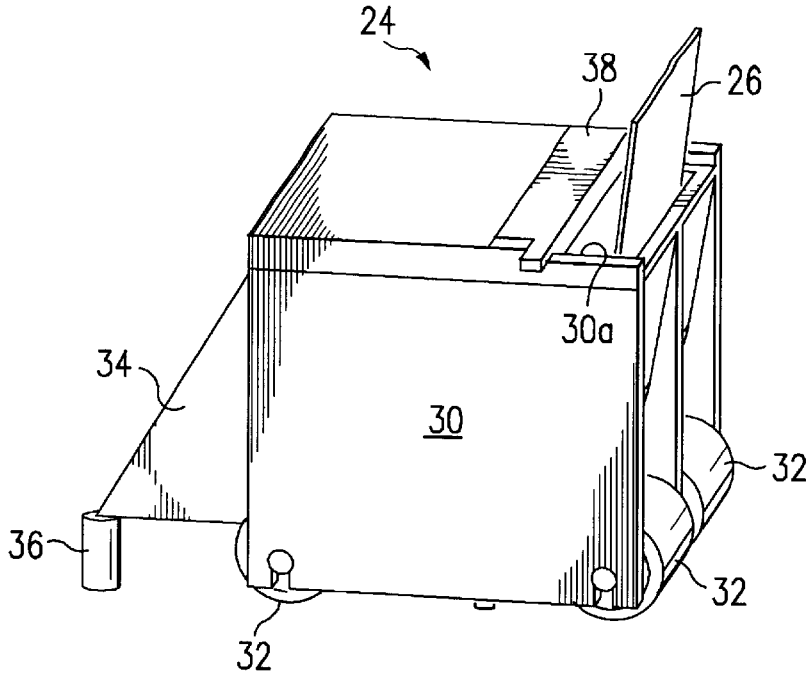
FIGS. 4 and 5 are isometric views of the carrier of the printing assembly of FIG. 3.
Figure 5:
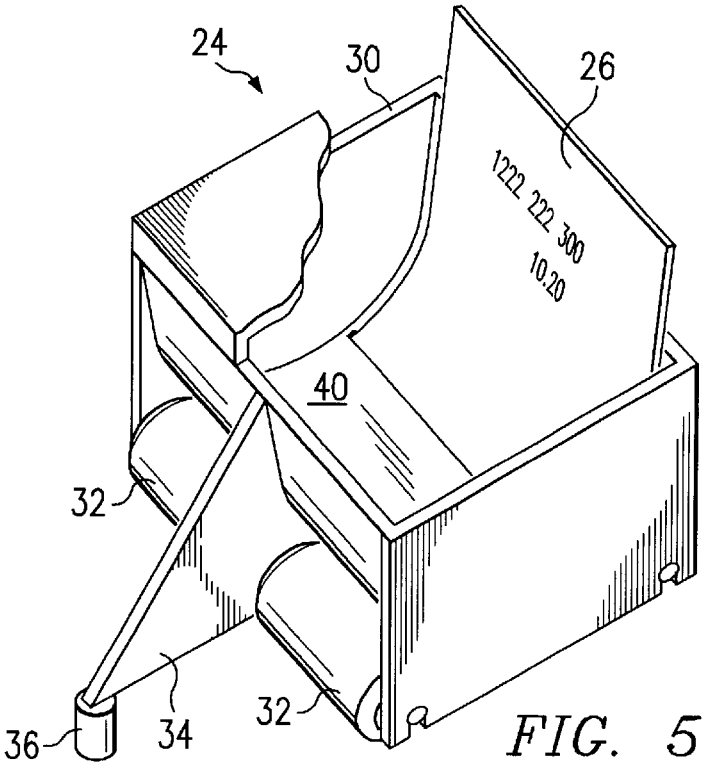

The carrier 24 is shown in detail in FIGS. 4 and 5 includes a housing 30 having two sets of two rollers 32 mounted at each end thereof. A flange 34 extends out from one end of the housing 30, and a vertically extending guide roller 36 is rotatably mounted on the end of the flange in any known manner.

A cover 38 is slidably mounted on the upper panel of the housing for movement between a retracted position shown in FIG. 4 in which it exposes a window 30*a* in the latter panel, and an extended position in which it covers the window. It is understood that this movement of the cover 38 can be achieved in any conventional manner such as by spring loading it to move to one position and by using a solenoid valve, or the like, (not shown) to move it to its other position. When the cover 38 is in its retracted position as shown in FIG. 4, the exposed window 30*a* receives the leading end section of the tape 26 from the printing head 22 under conditions to be described. A curved plate 40, shown in FIG. 5, is mounted in the housing 30 and extends from the window 30*a* downwardly to the bottom of the housing. The plate 40 receives a section of the tape 26 as it passes through the window and causes the leading end portion of the section to conform to the curved plate surface. The trailing end portion of the section of tape 26 projects upwardly from the housing 30 as viewed in FIG. 5.

Figure 6:
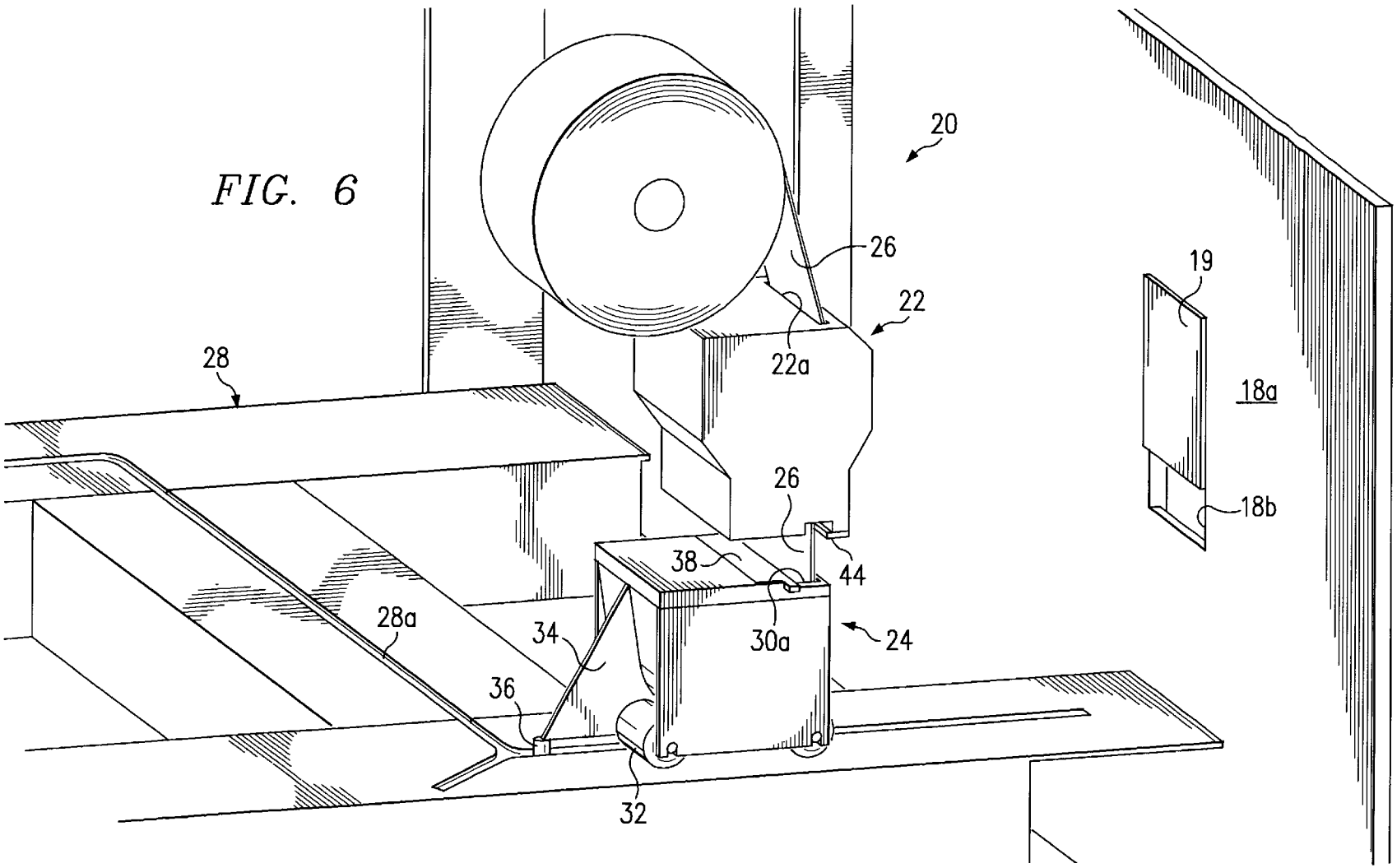
FIG. 6 is an enlarged isometric end view of the printing assembly of FIG. 3.

As shown in FIG. 6, a tear bar 44 is provided on the lower surface of the printing head 22 for tearing the leading end section of the tape 26 from the remaining portion thereof. When the leading end section of the tape 26 passes through the printing head 22 and into the carriage 24, the cover 38 is moved to its extended position to clamp the tape section between it and the corresponding wall of the carriage housing 30. The carriage 24 is then advanced towards the window 18*b* from the position shown in FIG. 6 to the position shown in FIG. 7. As a result, the portion of the tape 26 extending below the tear bar 44 is severed from the remaining portion of the tape by the tear bar. The severed section of the tape 26 forms a receipt and is ready for presentation to the customer, as will be described later.

Figure 7:
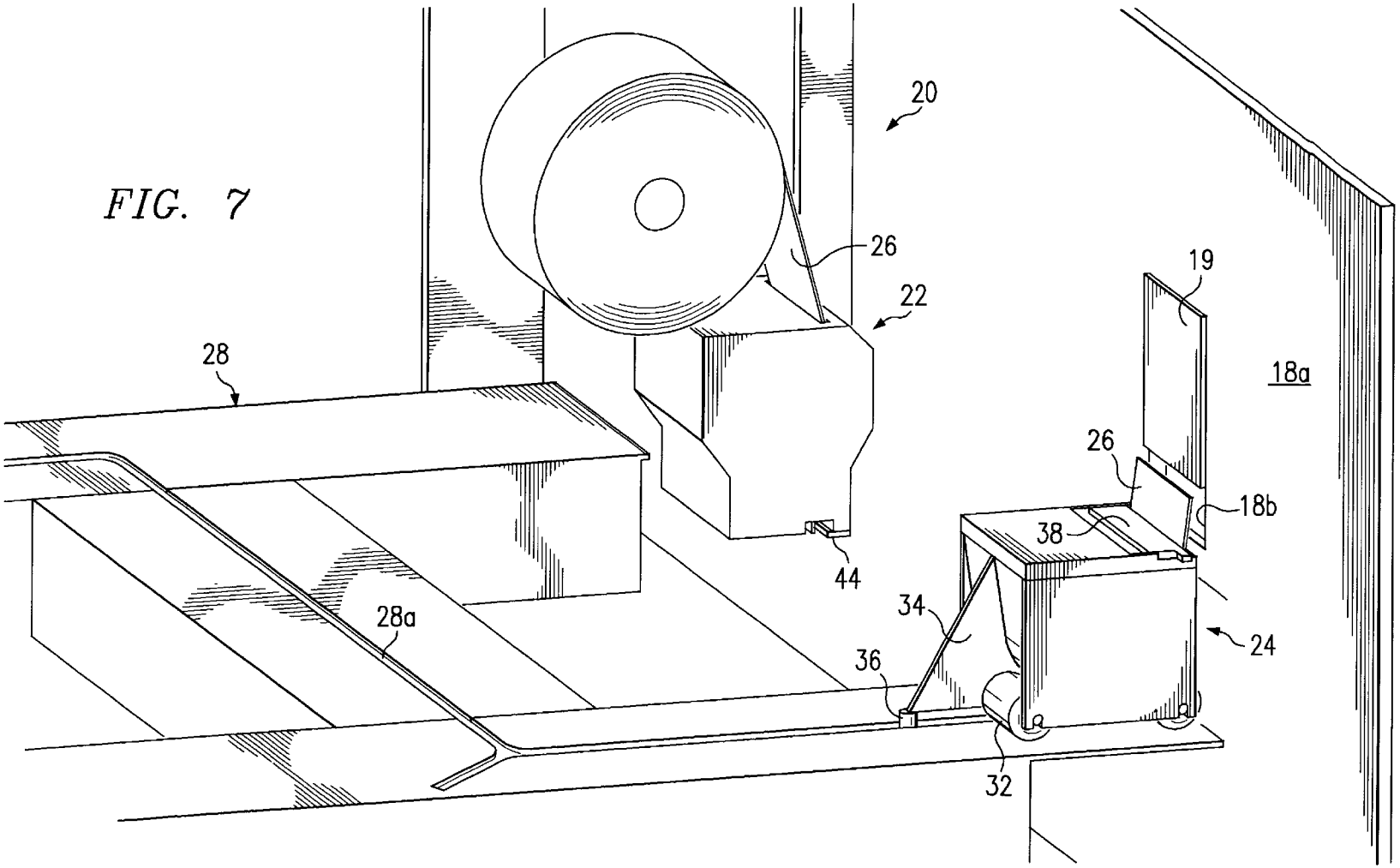
FIGS. 7 and 9 are views similar to that of FIG. 6 but showing the carrier in a different position.
Figure 8:
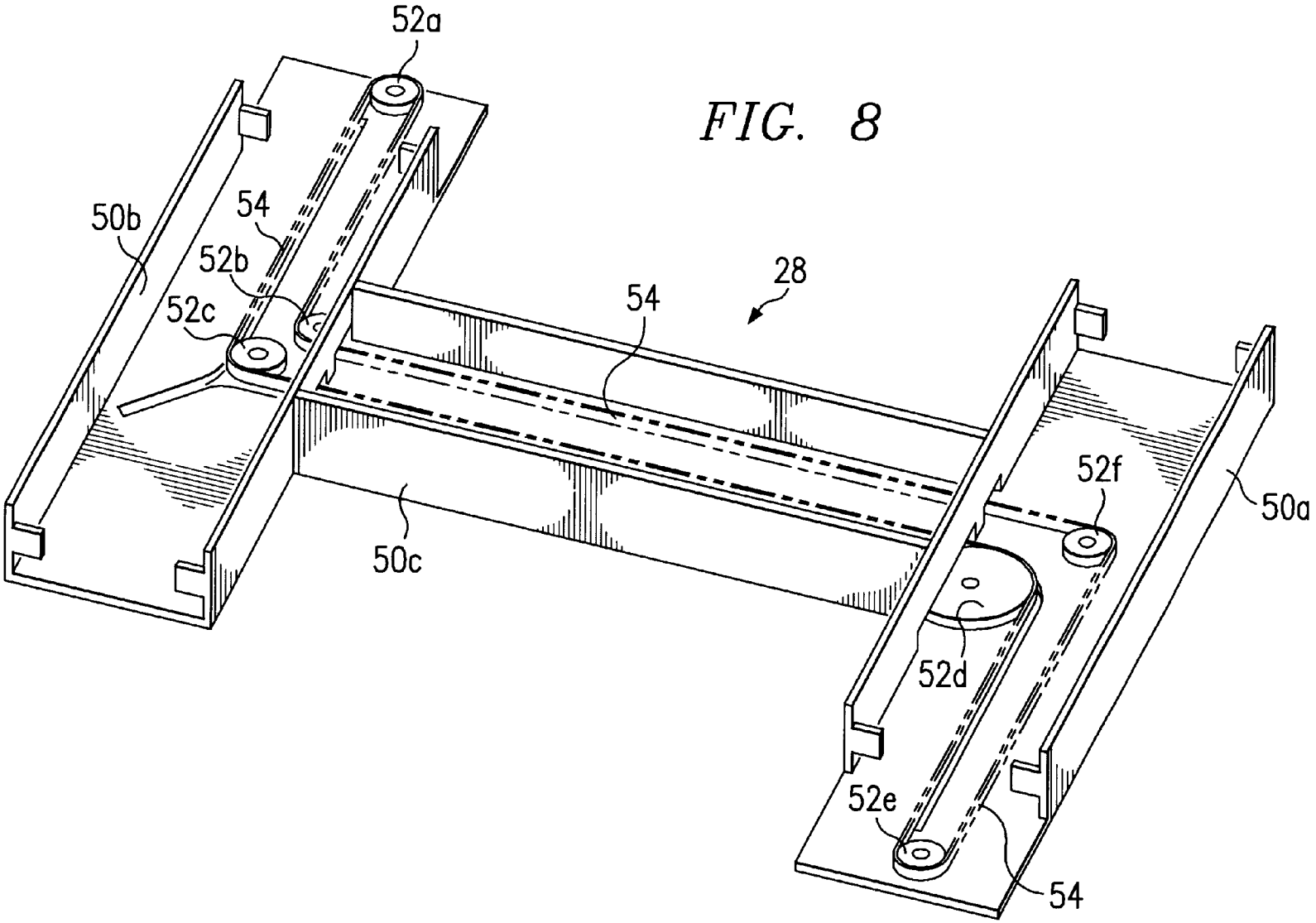
FIG. 8 is an isometric view of the track assembly of FIGS. 6 and 7, taken from the bottom thereof.

As also shown in FIGS. 6 and 7, the roller 36 extends in a slot 28*a* provided in the track assembly 28, to guide the movement of the carrier 24. The track assembly 28 is shown in better detail in FIGS. 8 and 9, and is formed of sheet metal formed into an approximately H-shaped pattern having two legs 50*a* and 50*b* and a center piece 50*c* connected to the legs and extending perpendicular to, and between, the legs.

Figure 9:
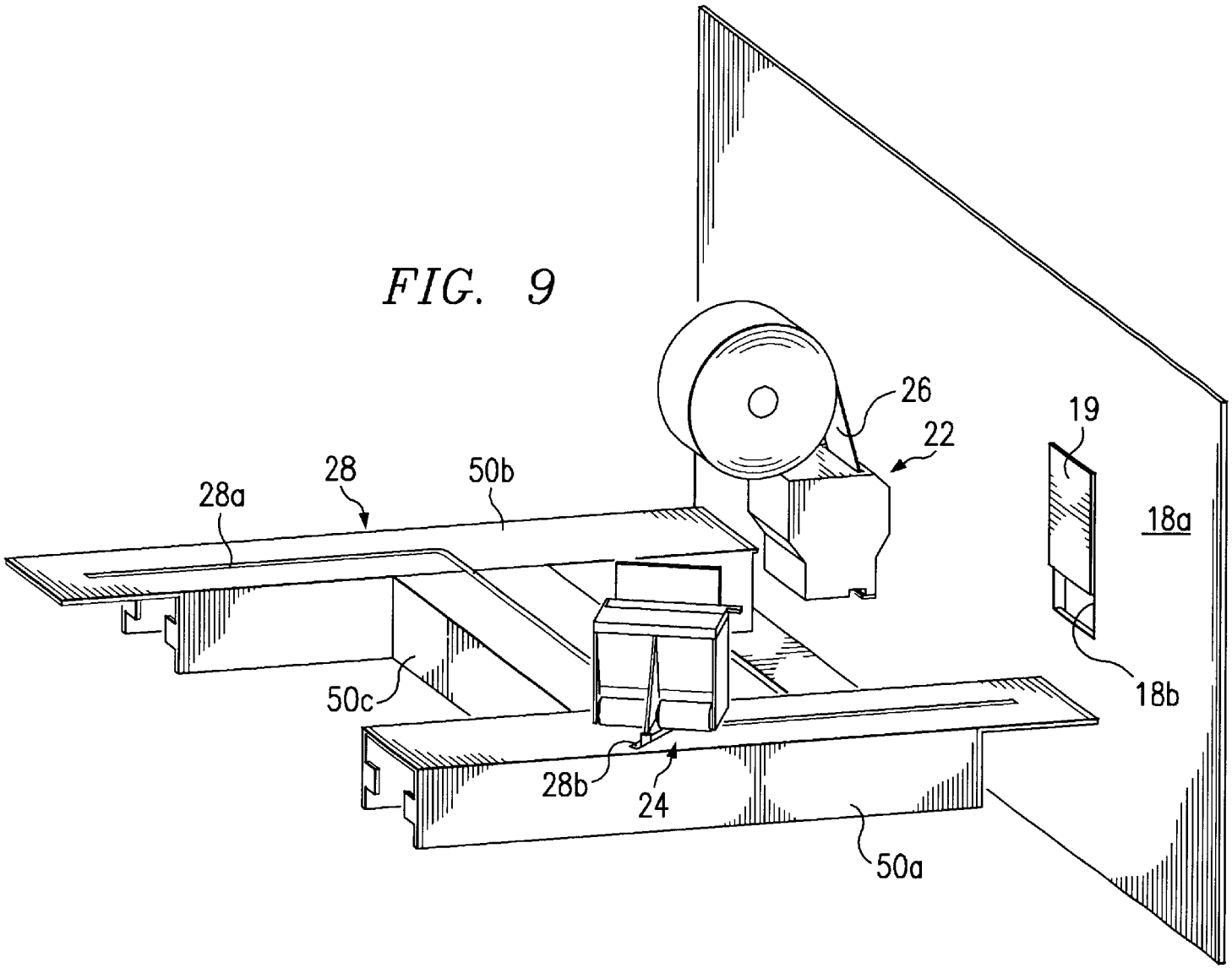

As shown in FIG. 9, the slot 28*a* extends for the entire length of the center piece 50*c* and through a portion of the legs 50*a* and 50*b* in opposite directions. The end of the slot 28*a* in the leg 50*a* is located near the front panel 18*a* of the cabinet 18, and the other end of the slot 28*a* in the leg 50*b* is located near the rear panel 18*c* (FIG.3) of the latter housing. Thus, the carrier 24 is adapted to deliver sections of the tape 26 to the opposite walls of the cabinet 18. An additional slot 28*b* is formed in the track section 50*a* at the intersection of the slot 28*a* in the latter section and in the section 50*c*. The slot 28*b* enables the carrier to reverse directions when moving from between the front wall 18*a* of the cabinet 18 and the rear wall thereof.

Three pulleys 52*a*–52*c* (FIG. 8) are rotatably mounted in the leg 50*a* of the track assembly 28 in any known manner and three pulleys 52*d*–52*f* are rotatably mounted in the leg 50*b*. An endless chain 54 is mounted over the pulleys 52*a*–52*f* in engagement therewith and moves in a path substantially corresponding to the path formed by the slot 28*a* which is not shown in FIG. 8 for the convenience of presentation. It is understood that the bottom of the carrier 24 (FIG. 7) is attached to a segment of the chain 54 in any conventional manner so that the chain can drive the carrier 24, with the roller 36 extending in the slot 28*a* to provide guidance, as shown in FIG. 7. It is also understood that a motor, or the like (not shown) is provided that is connected to the chain or to one of the pulleys 52*a*–52*e* to drive the chain 54, and therefore the carrier 24, in two directions. Thus, when the motor is actuated, the carrier 24 moves to and from the printing head 22 in two directions-one towards the front panel 18*a* of the cabinet 18 and the other towards the rear panel. Thus, the carrier 24 can be driven along the slot 28*a* between positions in which a section of the tape 26 can be dispensed from both ends of the housing 10.

In operation, it will be assumed that a customer dispenses gasoline from the front of the dispenser 10, as shown in FIG. 1 and therefore uses the nozzle 12*a*. Upon completion of the transaction, including the purchase of the gasoline by a credit card or the like, the leading end portion of the tape 26 is passed through the printing head 22 which prints information relating to the transaction, as shown in FIG. 6. The cover 38 on the carrier 24 is in its retracted position to expose the window 30*a* and the printed section of the tape 26 pays out from the roll, with its leading end section passing through the window and into the housing 30 of the carrier 24. The cover 38 is then moved to its extended position to clamp a portion of the tape 36 between it and the corresponding panel of the housing 30.

The above-mentioned motor is activated to drive the chain 54 (FIG. 8) in a direction to cause the carrier 24 to advance from the position shown in FIG. 6 to the position shown in FIG. 7. This movement pulls the tape 26 over the tear bar 44 to tear off the leading end section from the remaining tape 26 which forms a receipt for the transaction. The trailing portion of the severed section extends upwardly from the housing 30 of the carrier 24. The cover 38 is then retracted and the door 19 is moved upwardly (preferably by the customer) to expose the severed section of the tape 26, which can easily be removed by the customer.

If a customer dispenses gasoline from the rear of the dispensing unit 20 where the other end panel 18*c* (FIG. 3) is exposed, the carrier 24 would be initially moved in the manner described above to sever the leading end section of the tape. The direction of the chain 54 would then be reversed to move the carrier 24 into the slot 28*b* of the track assembly as shown in FIG. 9, where it reverses directions and passes to the window in the panel 18*c* for receipt by the customer.

Figure 10:
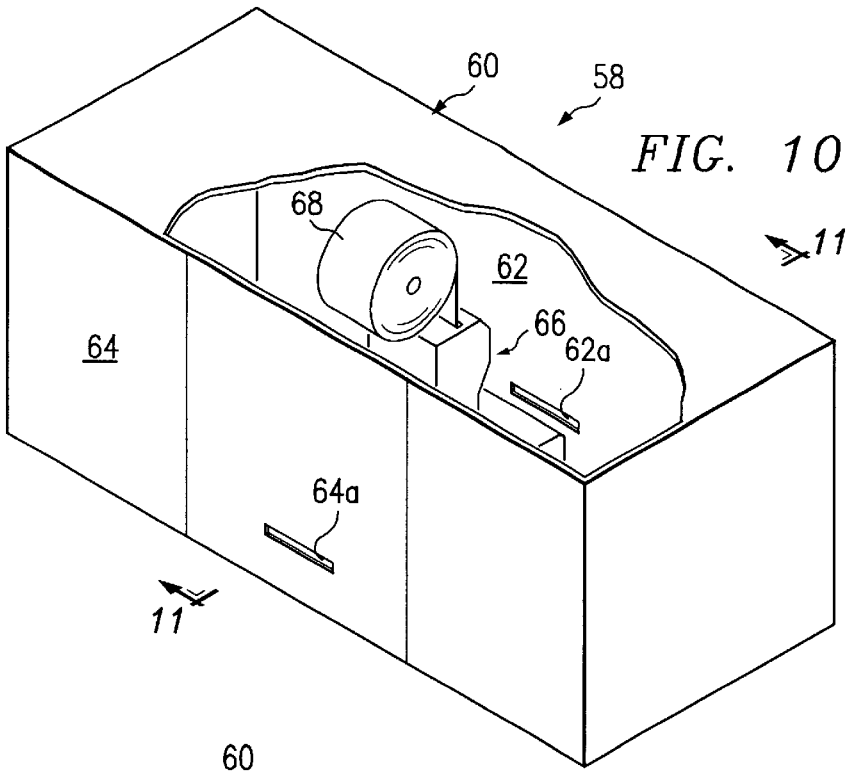
FIG. 10 is an isometric view of a printing module according to another embodiment of the present invention.
Figure 11:
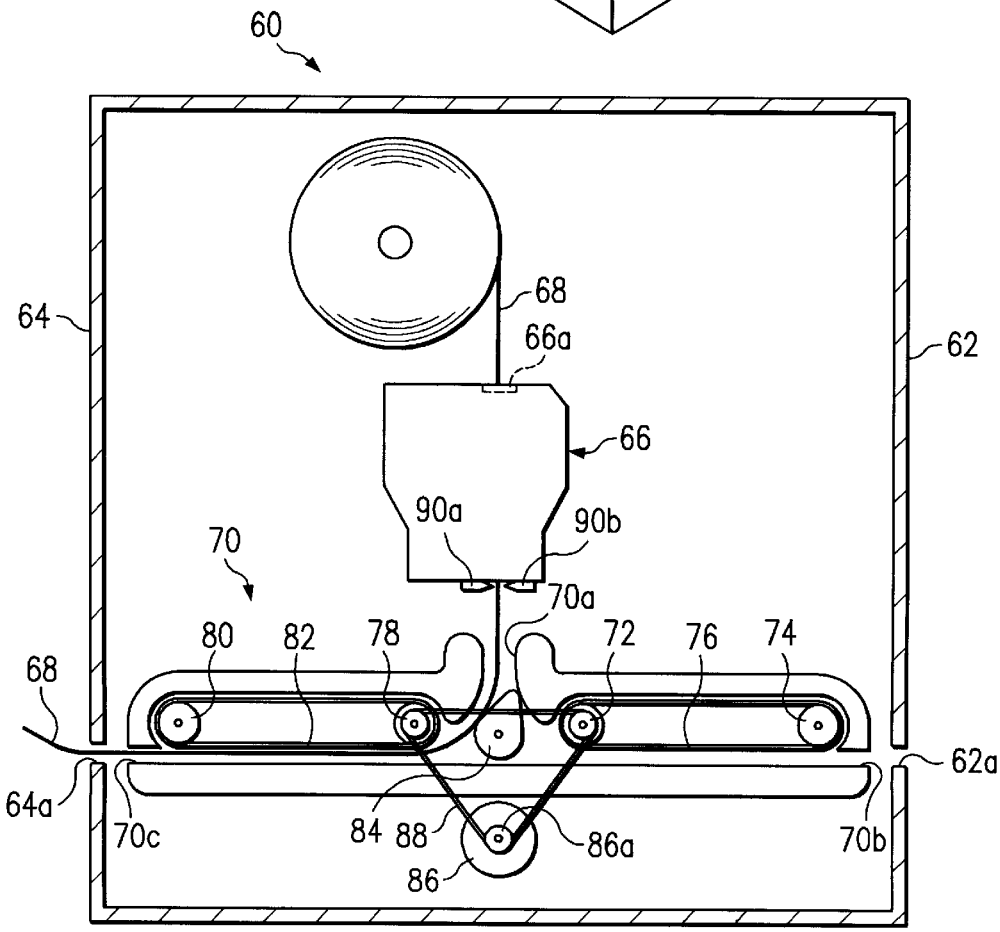
FIG. 11 is a sectional view taken along the line 11—11 of FIG. 10.

According to the alternate embodiment shown in FIGS. 10 and 11, the printing module 16 of the previous embodiment is replaced by a printing module 58, and the dispensing unit 10 is otherwise the same. The module 58 is located in the same place in the dispenser unit 10 as the printing module 16 and includes a cabinet 60 which includes two opposed end panels, or bezels, 62 and 64 having slots 62*a* and 64*a* respectively extending therethrough. The cabinet 60 is located in the dispenser unit 10 so that the slot 64*a* faces the front of the unit as shown in FIG. 1.

As shown in FIG. 11, a printing head 66 is mounted in the cabinet 60 and is adapted to receive tape 68 from a roll thereof positioned above the printing head. The printing head 66 is identical to the printing head of the previous embodiment and, as such, has a slot 66*a* formed therein for receiving the tape 68. The printing head 66 prints information on the tape 68 relating to each transaction involving dispensing gasoline from the dispenser unit 10, as in the previous embodiment. It is understood that the printing head 66 and the roll of tape 68 are mounted to the interior of the cabinet 60 by brackets, plates, or the like, which are not shown for the convenience of presentation, and in a manner to allow the tape 68 to pay out from the roll and into the slot 66*a* in the printing head.

A subhousing 70 is mounted in the lower portion of the cabinet 60 and has a slot 70*a* formed in the upper wall thereof for receiving the tape 68, as well as two additional slots 70*b* and 70*c* extending through the respective end walls thereof. Two spaced rollers 72 and 74 are mounted on one end of the subhousing 70 and receive an endless belt 76. Similarly, two additional spaced rollers 78 and 80 are mounted on the other end of the subhousing 70 and receive an endless belt 82. A guide lever 84 is pivotally mounted in the subhousing 70 and is located just inside the slot 70*a* for selectively guiding the tape passing through the slot to either the belt 76 or the belt 82 for further advancement through the subhousing, as will be described.

A motor 86 having a drive pulley 86*a* is disposed in the cabinet 60 externally of the subhousing 70. An endless belt 88 extends around the pulley 86*a* and the rollers 72 and 78 for driving the rollers and therefore the belts 76 and 82. The motor 86 is adapted to rotate the pulley 86*a* in a counter-clockwise direction, as viewed in FIG. 11, to drive the roller 72, and therefore the belt 76, in the same direction. The belt 76 is slightly spaced from the corresponding inner surface of the subhousing 70 to define a passage through which the tape passes. Although the height of the latter passage has been exaggerated somewhat for the convenience of presentation it is understood that the design is such that the tape is slightly pressed between the belt 76 and the latter surface so that the belt drives the tape 86 from the slot 70*a* to the slot 79*b*. The motor 86 is also adapted to drive the pulley 86*a* in a clockwise direction to drive the roller 78, and therefore the belt 82, in the same direction and the design is also such that this advances the tape 86 from the slot 70*a* to the slot 70*c*.

The slots 70*b* and 70*c* are in alignment with the slots 62*a* and 64*a*, respectively, of the cabinet 60 so that the tape 68 passes through the latter slots. The tape 68 is advanced in the foregoing manner until a predetermined length of the leading end portion of the tape 68 projects outwardly from the slot 64*a* as shown in FIG. 11 or from the slot 62*a* for access by the customer. Two slightly-spaced tear bars 90*a* and 90*b* are mounted to the lower end of the printer to either side of the tape 68 as it exits the printer. Therefore, when the customer pulls the projecting section of the tape 68 from the slot 62*a* or 64*a*, the leading end section of the tape will be severed from the remaining portion thereof by one of the bars 90*a* and 90*b*, respectively.

It is understood that the printing head 66, the roll of tape 68, the motor 86 and the guide lever 84 can be activated by a switch associated with the dispenser unit, and deactivated by a timer, another switch, or the like.

In operation, it will be assumed that a customer dispenses gasoline from the front of the dispensing unit 10 as shown in FIG. 1, using the nozzle 12*a*. Upon completion of the transaction, including the purchase of the gasoline by a credit card or the like, the leading end portion of the tape 68 is passed through the printing head 66 which prints information relating to the transaction. The guide lever 84 is moved to the position shown in FIG. 11 to guide the leading end section of the tape 68 towards the belt 82. The motor 86 is activated to rotate the pulley 86*a* in a clockwise direction to drive the belt 82 and advance the leading end section of the tape 68 towards and through the subhousing 70 and the aligned slots 70*c* and 64*a* until its leading end section projects from the subhousing 70 as shown in FIG. 11. The customer can grasp the projecting section of the tape 68 and pull upwardly so that the tear bar 90 cuts the section, from the remaining portion of the tape 68 which section forms a receipt for the transaction.

Of course, if a customer dispenses gasoline from the end of the dispensing unit where the end panel 62 of the cabinet is exposed, the motor is driven in a counter-clockwise direction and the guide lever 84 is moved to a position to direct the leading end section of the tape 68 toward the belt 76 and therefore the aligned slots 70*b* and 62*a*. The latter section is then cut by the tear bar 90*b* in the same manner as described above.

Figure 12:
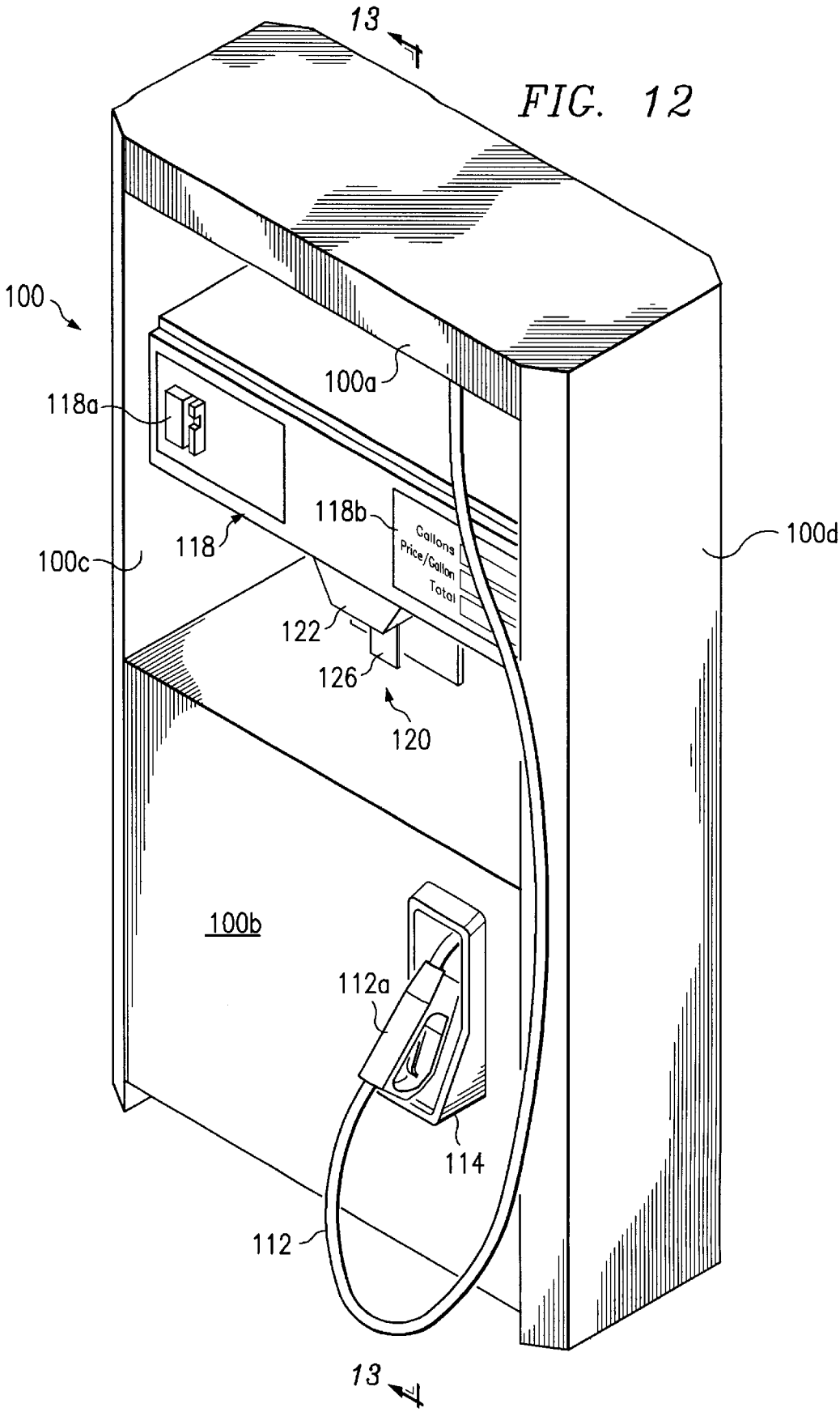
FIG. 12 is an isometric view of a dispensing unit according to another embodiment of the present invention.

Variations may be made in the embodiment of FIGS. 11 and 12 within the scope of the invention. For example, the tear bars 90 and 92 can be replaced by cutter bars which are adapted to be mechanically actuated to cut the leading end portion of the tape 86 from the remaining portion thereof. Thus, as soon as the leading end section of the tape 86 is printed and passes through the slot 70*a* and to the belt 76 or 82, it can be severed by the above cutters before its end reaches the slots 62*a* or 64*a* and the severed portion advanced towards the latter slots 62*a* and 64*a* in the manner described above for access by the customer.

Figure 13:
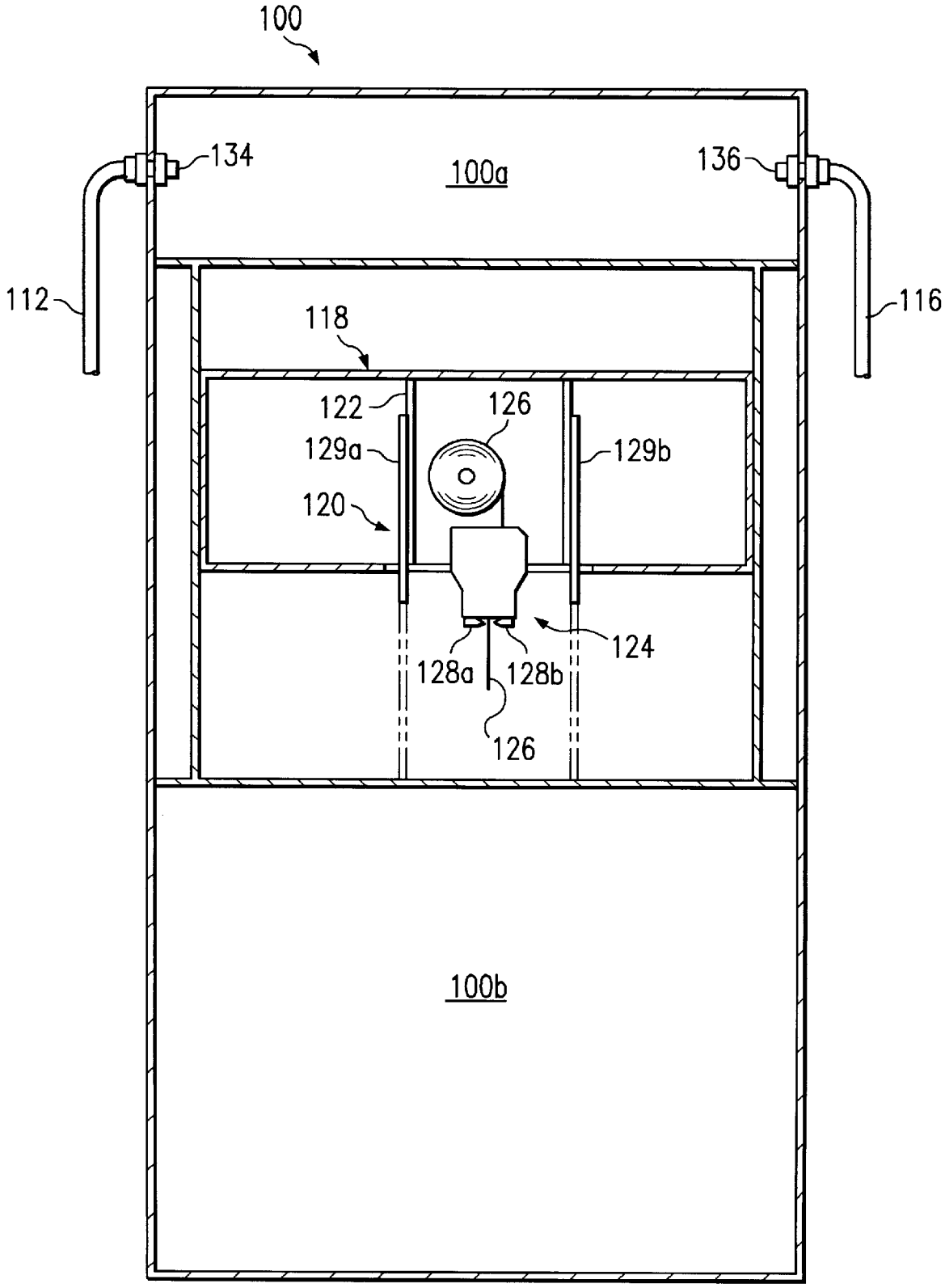
FIG. 13 is a sectional view taken along the line 13—13 of FIG. 12.

Another embodiment of the present invention is shown in FIGS. 12 and 13 and includes a dispenser unit 100 which is similar to the dispensing unit 10 and, as such has an upper housing 100*a* and a lower housing 100*b* connected by two spaced support members 100*c* and 100*d*. The lower housing 100*b* contains hydraulics (not shown) including conduits that are connected to underground storage tanks for gasoline to be dispensed.

A conduit (not shown) extends from the lower housing 100*b* to the upper housing 100*a* for passing gasoline to one end of a hose 112 extending from the front of the upper housing 100*a*. The other end of the hose 112 is connected to a nozzle 112*a* for dispensing gasoline from the storage tank to a vehicle. A boot 114 is provided on the front panel of the lower housing 100*b* for receiving the nozzle 112*a* during nonuse.

Another conduit (not shown) extends from the lower housing 100*b* to the upper housing 100*a* for passing gasoline to one end of a hose 116 (FIG. 13) extending from the rear end of the upper housing 110*a*. It is understood that a nozzle (not shown) is connected to the other end of the hose 116 for dispensing gasoline from the storage tank to a vehicle, and that a boot (not shown) is also provided for receiving it during nonuse.

An electronics housing 118 is provided in the upper housing 100*a* and contains various electronic components, including a credit card reader 118*a* and a display 118*b* which displays certain information relating the purchase of gasoline, as discussed above. The respective fronts of the reader 118*a* and the display 118*b* extend through the front panel, or bezel, of the housing 118. Although not shown in the drawing, it is understood that the electronics housing 118 extends to the rear end of the dispensing unit 100 so that customers can be serviced from both the front and the rear of the dispenser unit. Since all of this is conventional, it will not be described in further detail.

As shown in FIG. 13 a printing assembly 120 is mounted in the electronic housing 118 and includes a cabinet 122 which receives a printing head 124 in the lower portion thereof. As shown in FIG. 12, the lower portion of the printing head 124 projects downwardly from the lower portion of the cabinet 122 and from the housing 118 and in the space between the support members 100*c* and 100*d* and between the upper housing 100*a* and the lower housing 100*b*.

A roll of tape 126 (FIG. 13) extends over the printing head and since the printing head 124 and the tape 126 are identical to the printing head and the tape of the previous embodiments, they will not be described in detail. It is understood that the cabinet 122 is mounted in the electronics housing 118, and the printing head 124 and roll of tape 126 are mounted in the cabinet, by brackets, plates, or the like, which are not shown for the convenience of presentation, and in a manner to allow the tape 126 to pay out from the roll and into the slot in the printing head as discussed above.

Two tear bars 128*a* and 128*b* are mounted on the lower end of the printing head 124 to either end of the tape 126 as it exits the head. The tear bars 128*a* and 128*b* are adapted to sever the tape 126 when it is pulled towards the bars. Therefore, if a customer dispenses gas from the front of the dispensing unit 100 as shown in FIG. 12, and therefore uses the nozzle 112*a*, he or she would pull the leading end section of the tape 126 towards the tear bar 128*a* to sever the tape. Similarly, if the customer dispenses gasoline from the rear end of the dispensing unit, and therefore uses the nozzle 116*a*, he or she would pull the leading end section of the tape 126 towards the tear bar 128*b* to sever the tape.

Two shields 129*a* and 129*b* are respectively mounted to the end walls of the cabinet 122 and are adapted to move from a retracted position shown by the solid lines to a extended position shown by the dashed lines in FIG. 13. It is understood that this movement of the shields 128*a* and 129*b* can be achieved in any conventional manner such as by spring loading them to move to one position and by using a solenoid valve, or the like, (not shown) to move them to their other positions.

In operation, it will be assumed that a customer dispenses gasoline from the nozzle 112*a* from the front of the dispenser unit 100 as viewed in FIG. 12. Upon completion of the transaction, including the purchase of the gasoline by a credit card or the like, the roll of tape 126 (FIG. 13) is rotated to advance the leading end section of the tape through the printing head 124 which prints information relating to the transaction. The shield 129*b* is dropped to the shielding position shown by the dashed lines in FIG. 13 to shield the printed section of tape from a customer at the rear end of the dispenser unit 100, and the printed section of tape is advanced through the lower, open end the housing 122 of the printing assembly 120 so as to project from the latter end.

After completing the dispensing of gasoline through the nozzle 112*a*, the customer can grasp the projecting tape section and pull it until the tear bar 128*a* severs the printed leading end section from the remaining portion of the tape 126 which forms a receipt for the transaction. Of course, if a customer dispenses gasoline from the nozzle of hose 116 on the other end of the dispensing unit 100, the operation is identical to that just described with the exception that the shield 129*a* is activated and lowered to a shielding position. It is understood that the printing head 124, the roll of tape 126, and the shields 129*a* and 129*b* can be activated by a switch associated with the dispenser unit, and deactivated by a timer, another switch, or the like.

According to all three embodiments of the present invention, printing can be achieved for customers dispensing gasoline from both ends of a dispenser utilizing a single printing assembly. To this end, a receipt is dispensed from a single printer serving two customers and is presented to the proper customer while preventing access to the receipt by the other customer. Major advantages are thus achieved with the embodiments of the present invention since the costs, complexity and space requirements of two printing assemblies are eliminated. Also, the embodiments of the present application are relatively simple in construction and durable and can use the bezels, or end panels, of a standard printing assembly with little modification.

It is understood that modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A gasoline dispensing system comprising a housing having two receipt delivery openings at two locations, respectively, a hose extending from one of the locations for receiving gasoline, a hose extending from the other location for receiving gasoline, a dispensing nozzle disposed at one end of each of the hoses for dispensing the gasoline, a printer for printing a receipt for the dispensing of the gasoline from either location, a carrier for receiving the printed receipt from the printer, and a drive system for moving the carrier to one of the openings when gasoline is dispensed at the location corresponding to the one opening, and to the other opening when gasoline is dispensed at the location corresponding to the other opening.

2. The system of claim 1 wherein the receipt is printed on a roll of tape and further comprising a severing member mounted on the printer for severing the leading end section of the tape from the remaining portion thereof to form the receipt.

3. The system of claim 2 wherein the severing is effected by the movement of the carrier causing the leading end section of the tape to engage the severing member.

4. A gasoline dispensing system comprising a housing having two receipt delivery openings at two locations, a hose extending from one location of the housing for receiving gasoline, a hose extending from another location of the housing for receiving gasoline, a dispensing nozzle disposed at one end of each of the hoses for dispensing the gasoline, a printer for printing a receipt for the dispensing of the gasoline from either location, two endless belts mounted in the housing a portion of each of which is in a closely spaced relation to corresponding surfaces of the housing, and a guide member adapted to direct the printed receipt to the space between one of the belts and the corresponding surface to advance the receipt to one of the openings for access, the guide member also adapted to direct the receipt to the space between the other belt and the other surface area to advance the receipt to the other location for access.

5. The system of claim 4 wherein the receipt is printed on a roll of tape and further comprising a severing member mounted on the housing for severing the leading end section of the tape from the remaining portion thereof to form the receipt.

6. A method for providing receipts in connection with the dispensing of gasoline from two different locations at a dispenser unit, the method comprising the steps of positioning a printer in the dispenser unit so that the printer is accessible from both locations, printing a receipt at the printer, providing a shield at each location that moves between a first position in which it permits access to the printed receipt at the printer and a second position in which it prevents access to the printed receipt at the printer, dispensing gas at one of the locations, printing a receipt for the dispensed gasoline at the printer, responding to the step of dispensing and moving at least one of the shields so that the shield corresponding to the one location is in the first position and the shield corresponding to the other location is in the second position, dispensing gas at the other location, printing a receipt for the latter dispensed gasoline at the printer, responding to the latter step of dispensing and moving at least one of the shields so that the shield corresponding to the other location is in the first position and the shield corresponding to the one location is in the second position.

7. The method of claim 6 further comprising the step of dispensing gasoline at the other location, printing a receipt for the latter gasoline at the printer, responding to the latter step of dispensing for moving the shield corresponding to the other location to the first position and moving the shield corresponding to the one location to the second position.

8. The method of claim 6 further comprising the step of providing a roll of tape, feeding the tape into the printer for printing information relating to the transaction on the leading end section of the tape, and severing the leading end section of the tape from the remaining portion thereof to form the receipt.

9. The method of claim 8 wherein the step of severing occurs when the leading end section is pulled from the printer and over a severing member.

10. A system for providing receipts for gasoline dispensing transactions according to which gasoline is dispensed from two different locations at a dispenser unit, the system comprising a printer for printing a receipt, the printer being positioned in the dispenser unit so that the printer is accessible from both locations, a shield disposed at each location and adapted to move between a first position in which it permits access to the printed receipt at the printer and a second position in which it prevents access to the printed receipt at the printer, wherein at least one of the shields is moved in response to the dispensing of gasoline at each location so that the shield corresponding to the location in which the gasoline is dispensed is in the first position and the shield corresponding to the other location is in the second position.

11. The system of claim 10 wherein the shield at the other location moves to its first position in response to the dispensing of gasoline at the other location, and the shield at the one location moves to its second position in response to the dispensing of gasoline at the other location.

12. The system of claim 10 wherein the receipt is printed on a roll of tape and further comprising a severing member mounted on the printer for severing the leading end section of the tape from the remaining portion thereof when the leading end section is pulled from the printer.

13. A method for providing receipts in connection with the dispensing of gasoline from two different locations at a dispenser unit, the method comprising dispensing gas at one of the locations, providing a printer in the dispenser unit, printing a receipt for the dispensed gasoline at the printer, feeding the printed receipt to a carrier, moving the carrier to a receipt delivery opening in the dispenser unit corresponding to the one location to permit access to the printed receipt, dispensing gasoline at the other location, printing a receipt for the latter gasoline at the printer, feeding the latter printed receipt to the carrier, and moving the carrier to a receipt delivery opening in the dispenser unit corresponding to the other location to permit access to the printed receipt.

14. The method of claim 13 further comprising the step of providing a roll of tape, feeding the tape into the printer for printing information relating to the transactions on the leading end section of the tape, and severing the leading end section of the tape from the remaining portion thereof to form the receipt.

15. The method of claim 14 wherein the step of severing is effected by the movement of the carrier causing the leading end section of the tape to engage a severing member.

* * * * *